US007509934B2

(12) United States Patent
Stemmer

(10) Patent No.: US 7,509,934 B2
(45) Date of Patent: Mar. 31, 2009

(54) DEVICE FOR GUIDING MEDIA IN A CYLINDER BLOCK AND CRANKCASE

(75) Inventor: Xaver Stemmer, Reichertshofen (DE)

(73) Assignee: Audi AG, Ingolstadt (DE)

( * ) Notice: Subject to any disclaimer, the term of this patent is extended or adjusted under 35 U.S.C. 154(b) by 175 days.

(21) Appl. No.: 10/569,449

(22) PCT Filed: Aug. 28, 2004

(86) PCT No.: PCT/EP2004/009601

§ 371 (c)(1),
(2), (4) Date: Feb. 24, 2006

(87) PCT Pub. No.: WO2005/024215

PCT Pub. Date: Mar. 17, 2005

(65) Prior Publication Data

US 2006/0249104 A1 Nov. 9, 2006

(30) Foreign Application Priority Data

Sep. 1, 2003 (DE) ..... 103 40 157

(51) Int. Cl.
*F01P 9/00* (2006.01)

(52) U.S. Cl. ..... 123/195 R; 123/41.01

(58) Field of Classification Search ..... 123/195 R, 123/196 R, 41.01
See application file for complete search history.

(56) References Cited

U.S. PATENT DOCUMENTS

| | | | |
|---|---|---|---|
| 4,850,312 | A | 7/1989 | Schwab |
| 6,341,659 | B1 | 1/2002 | Ibukuro |

FOREIGN PATENT DOCUMENTS

| | | | |
|---|---|---|---|
| DE | 3300924 | C2 | 7/1984 |
| DE | 3601383 | A1 | 7/1987 |
| DE | 43 35 492 | A1 | 4/1995 |
| DE | 43 41 040 | | 6/1995 |
| DE | 43 41 040 | A1 | 6/1995 |
| DE | 197 34 654 | C1 | 8/1998 |
| JP | 61182442 | A | 8/1986 |

*Primary Examiner*—Noah Kamen
(74) *Attorney, Agent, or Firm*—Novak Druce & Quigg LLP

(57) ABSTRACT

The invention relates to a device for guiding media in a cylinder block and crankcase of a reciprocating piston in-line combustion engine having a number of cylinders. To this end, the media guide comprises, among other things, at least one cross-channel that leads from one longitudinal side to the other longitudinal side of the cylinder block and crankcase. A structurally advantageous and simple design is provided by virtue of the fact that the cross-channel runs inside a free space, which is formed by recesses of two adjacent pistons in the lower area of the piston skirts and above the crankshaft bearing of the combustion engine.

8 Claims, 1 Drawing Sheet

DEVICE FOR GUIDING MEDIA IN A CYLINDER BLOCK AND CRANKCASE

CROSS-REFERENCE TO RELATED APPLICATIONS

This application is a § 371 application of PCT/EP2004/009601, filed Aug. 28, 2004, which claims priority from DE 10340157.1, filed Sep. 1, 2003.

The invention relates to a device for guiding media in the cylinder block and crankcase of a reciprocating piston in-line internal combustion engine with several cylinders.

BACKGROUND OF THE INVENTION

Cross channels of the generic type are known in cylinder blocks of internal combustion engines both for lubricating oil supply and also as coolant guides for the cooling system in a plurality of versions (compare for example DE 43 41 040 A1 or DE 36 01 383 A1). Due to the restricted space conditions, the wall thicknesses of the cylinder block which are as thin as possible, and/or due to bordering functional parts these cross channels are generally complex in their geometry and restricted in the flow cross section.

The object of the invention is to devise a device of the generic type which can be produced with simple channel routing and an adequately dimensioned flow cross section even with restricted installation space.

SUMMARY OF THE INVENTION

It is proposed that at least one cross channel runs in a free space which is formed by recesses of two adjacent pistons in the lower region of the piston skirt and above the crankshaft bearing. Thus the cross channel can be made with a larger diameter than the distance of the cylinders to each other (gusset distance), by which the number of cross channels can be reduced and/or the flow performance can be raised. Moreover channel routing is simplified, optionally without required flow deflections.

Preferably the cross channel can be used for coolant routing between the bilateral cooling spaces of the internal combustion engine, although the corresponding cross channels can be provided as an alternative or in addition for lubricating oil supply of the internal combustion engine.

In terms of production engineering, the cross channel can be formed especially easily by a tube inserted into a transverse hole of the cylinder block. In addition to simplified channel routing and castability of the cylinder block and crankcase, machining of the cylinder faces (drilling, honing) is simplified by the tube forming the cross channel being inserted only after completed machining of the cylinder tracks and the entire cylinder block and crankcase and therefore not hindering the preceding machining steps.

Furthermore, it is suggested that in an internal combustion engine with ventilation openings provided between the cylinder bores in the cross walls of the cylinder block and crankcase the tube crosses the ventilation openings. Thus the preferably thin-walled tube bridges these ventilation openings and permits an even more compact configuration of the cross channel.

The cross channel can preferably be connected on one side directly to the water pump of the internal combustion engine by way of a supply and thus can effectively supply coolant to the longitudinal side of the in-line internal combustion engine facing away from the water pump.

Furthermore, at least one cross channel can run above the longitudinal channel of the pressurized recirculation lubricating system of the internal combustion engine, which channel is located in the cylinder block and crankcase, and thus can reduce the production cost while avoiding channel deviations. Both the cross channel and also the indicated longitudinal channel can be produced by the corresponding straight-line boring operations.

In addition, the cross channel in an internal combustion engine with two countershafts located on both sides of the cylinders can be especially advantageous when made to tilt such that it runs underneath the countershaft which is higher and above the second countershaft which is lower. Accepting a slight tilt of the cross channel, the clearance of the countershafts and a configuration of their bearing points in the cylinder block and crankcase which is more favorable for production engineering are easily ensured.

Finally the pistons can be so-called box pistons or slipper pistons with piston skirts which form only lateral guides of the pistons transversely to the longitudinal axis of the in-line internal combustion engine by corresponding symmetrical recesses in the area underneath the piston rings.

DETAILED DESCRIPTION OF THE PREFERRED EMBODIMENTS OF THE INVENTION

Figure 1:
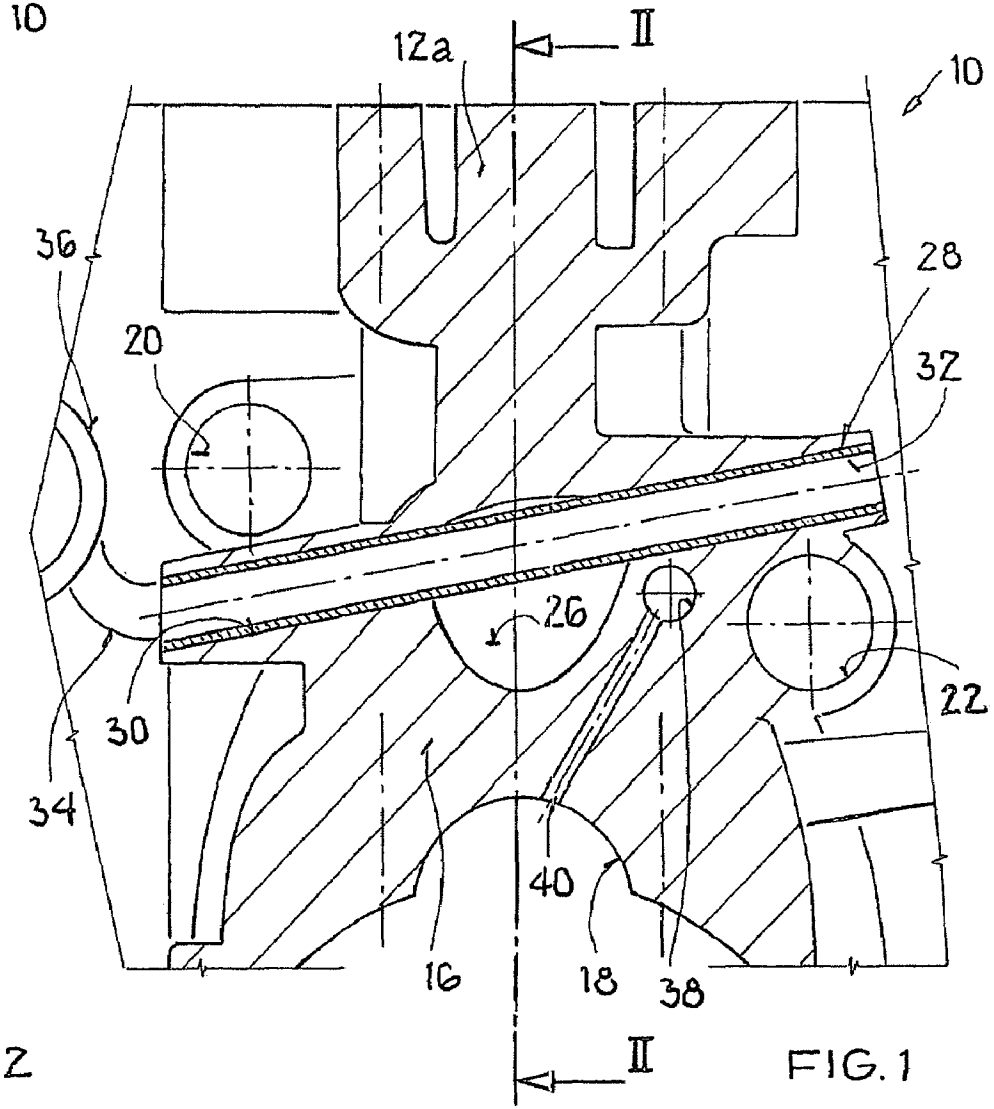
FIG. 1 shows a partial cross section along line I-I of FIG. 2 through the cylinder block of a four-cylinder, in-line reciprocating piston internal combustion engine with a cross channel made as a tube in the gusset area between the two adjacent cylinders.

In FIG. 1, the cylinder block of a four cylinder, in-line reciprocating piston internal combustion engine of conventional design, to the extent not shown or described, which cylinder block is shown in sections, is designated as 10.

In the cylinder block 10 the cylinders 12 (compare FIG. 2) are made with the corresponding contact surfaces for the pistons 14.

The pistons 14 are drive-connected in the known manner to the crankshaft of the internal combustion engine by way of piston pins and connecting rods which are not shown.

The crankshaft is pivot-mounted in the cross walls 16 of the cylinder block and crankcase 10 and in the corresponding front walls (not visible), the corresponding thrust bearings 1.8 being incorporated into the cross walls 16, which with screw-on bearing caps (not shown) form the main bearing of the crankshaft.

Furthermore in the cylinder block and crankcase 10 on both sides of the axis of rotation of the crankshaft or on the longitudinal sides there are bearing points 20, 22 in which countershafts (not shown) are pivot-mounted for equalization of free inertia forces and moments of inertia of the second order of the internal combustion engine.

The pistons 14 are made as so-called box pistons with piston skirts which are provided underneath the piston rings (without reference numbers) with symmetrical recesses 14*a* so that the pistons 14 in their lower area are guided only in the transverse direction (according to the section plane of FIG. 1) in the cylinders 12.

Figure 2:
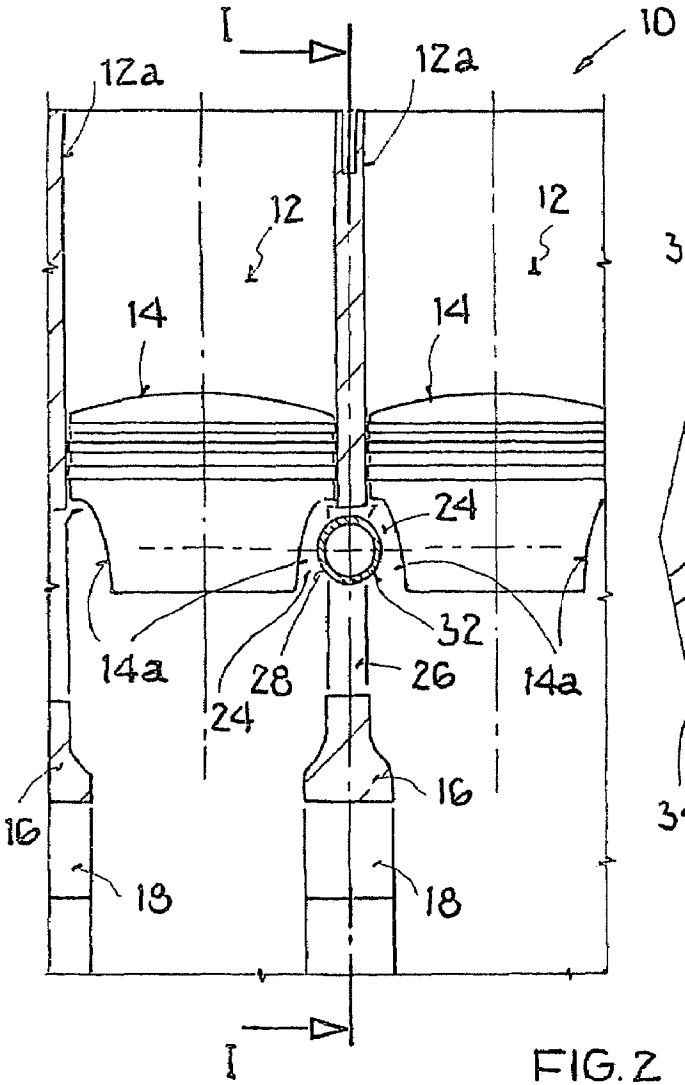
FIG. 2 shows a longitudinal section along line II-II of FIG. 1 through the cylinder block which is shown in sections.

The cylinder walls 12*a* of the cylinders 12 end in the areas of the pistons 14 which are lateral relative to the longitudinal direction of the cylinder block 10, as is to be seen in FIG. 2;

at bottom dead center of the piston 14 as a result of the ventilation openings 26 barely underneath the rotationally symmetrical areas of the piston 14 with the piston rings, by which in the gusset area (cylinder walls 12*a* of adjacent cylinders 12, which walls undergo transition into each other), as is to be seen one respective free space 24 is formed, is bordered by the recesses 14*a* of the piston 14, and moreover lies above the crankshaft bearing with the thrust bearing 18.

The cylinder tracks thus end in the area of the recesses 14*a* of the pistons 14 as a result of the ventilation openings 26 underneath the piston rings and in the area of the pistons 14 relative to the transverse direction of the cylinder block 10 more or less with the lower edge of the piston skirt, so that lateral guides of the pistons 14 are formed only transversely to the longitudinal axis of the cylinder block 10.

The ventilation openings 26 provided in the cross walls 16 of the cylinder block 10 (compare FIG. 1) connect the crankcase spaces lying between the cross walls 16 of the cylinder block 10 (and which are bordered to the lower side by the oil pan which is not shown) with each other for purposes of pressure compensation.

In the indicated free space 24 there is a cross channel 28 which is comprised of a corresponding hole 30 in the cylinder block 10 and a thin-wall tube 32, the tube 32 being inserted tightly into the hole 30. This can be accomplished by pressing in and/or inserting the corresponding gaskets.

The tube 32 extends unsupported through the ventilation opening 26 and is configured at a incline such that it (compare FIG. 1) runs underneath the countershaft (bearing point 20) which is higher and above the countershaft (bearing point 22) which is lower, still acceptable wall thicknesses between the indicated bearing points 20, 22 and the hole 30 for the tube 32 being provided or considered.

The cross channel 28 as shown schematically in FIG. 1 is connected directly to the pump housing 36 of the water pump (not shown) of the internal combustion engine by way of a tubular branch 34 and supplies liquid coolant to the coolant spaces (not shown) configured on the opposite side of the cylinder block 10. The indicated pump housing 36 is integrated into the cylinder block 10.

Underneath the cross channel 28, a longitudinal channel 38 is cast into the cylinder block 10 on one side of the axis of rotation of the crankshaft and as part of the pressurized circulation lubricating system of the internal combustion engine supplies lubricating oil to the crankshaft bearings 18 among others by way of branch channels 40.

Instead of one cross channel 28, there can also be several cross channels in the other cross walls 16 of the cylinder block 10. Here the cross channels 28 can also carry other media, in particular lubricating oil from the lubricating system of the internal combustion engine. The cylinder block 10 can furthermore be provided with cylinder liners which have the indicated contact surfaces for the pistons 14 in a manner which is not shown.

The invention claimed is:

1. A cylinder block of an internal combustion engine including at least two cylinders separated by a partition wall and pistons disposed in said cylinders, each having an annular recess in a lower, side portion thereof, wherein there is provided in said partition wall a passageway disposed in a substantially transverse plane relative to a longitudinal centerline of said block, having at least a portion thereof disposed at substantially the level of the annular recess of one of said pistons when said one piston is in a lowest position in its line of travel within the cylinder thereof and communicable with a fluid for passage therethrough.

2. A cylinder block according to claim 1 wherein said passageway forms a segment of a coolant circuit.

3. A cylinder block according to claim 1 wherein said passageway includes a conduit.

4. A cylinder block according to claim 3 wherein said partition wall includes an opening intercommunicating adjacent cylinders, and said conduit intersects said opening.

5. A cylinder block according to claim 1 wherein said passageway communicates with a water pump.

6. A cylinder block according to claim 1 wherein said cylinder block includes a passageway for passing a lubricating fluid and said first mentioned passageway extends at a level above said lubricating fluid passageway.

7. A cylinder block according to claim 1 wherein said cylinder block includes a pair of longitudinally disposed shafts, spaced at different levels, and said passageway extends between said shafts.

8. A cylinder block according to claim 1 wherein each of said pistons consists of one of box and slipper pistons.

* * * * *